US011865598B2

(12) United States Patent
Piniek et al.

(10) Patent No.: US 11,865,598 B2
(45) Date of Patent: Jan. 9, 2024

(54) METHOD FOR MANUFACTURING FLEXIBLE ROLLING OF METAL STRIPS

(71) Applicant: OUTOKUMPU OYJ, Helsinki (FI)

(72) Inventors: Thorsten Piniek, Krefeld (DE); Andreas Zeidler, Haiger (DE); Stefan Schuberth, Düsseldorf (DE)

(73) Assignee: Outokumpu Oyj, Helsinki (FI)

( * ) Notice: Subject to any disclaimer, the term of this patent is extended or adjusted under 35 U.S.C. 154(b) by 162 days.

(21) Appl. No.: 17/353,897

(22) Filed: Jun. 22, 2021

(65) Prior Publication Data

US 2021/0346927 A1 Nov. 11, 2021

Related U.S. Application Data

(62) Division of application No. 16/474,434, filed as application No. PCT/EP2017/083296 on Dec. 18, 2017, now abandoned.

(30) Foreign Application Priority Data

Dec. 30, 2016 (EP) ..... 16207599

(51) Int. Cl.
*B21B 13/14* (2006.01)
*B21B 37/26* (2006.01)
(Continued)

(52) U.S. Cl.
CPC ..... *B21B 13/147* (2013.01); *B21B 37/26* (2013.01); *B21B 38/02* (2013.01); *B21B 37/38* (2013.01); *B21B 37/58* (2013.01); *B21B 2261/05* (2013.01)

(58) Field of Classification Search
CPC ..... B21B 37/16; B21B 37/18; B21B 37/24; B21B 37/26; B21B 37/28; B21B 38/02;
(Continued)

(56) References Cited

U.S. PATENT DOCUMENTS 3,531,961 A * 10/1970 Dunn ..... B21B 37/16 72/10.4
6,336,349 B1 * 1/2002 Hauger ..... B21B 37/26 72/240
(Continued)

FOREIGN PATENT DOCUMENTS

CN 201316741 Y 9/2009
CN 104741377 A 7/2015
(Continued)

OTHER PUBLICATIONS

Revue de Metallurgie (NPL: SI-FLAT contactless flatness measurement for cold rolling mills and processing lines) https:/Awww.researchgate.net/publication/45703735_SI-FLAT_contactless_flatness_measurement_for_cold_rolling_mills_and_processing_lines (Year: 2005).*
(Continued)

*Primary Examiner* — Bobby Yeonjin Kim
(74) *Attorney, Agent, or Firm* — Quinn IP Law

(57) ABSTRACT

A method for manufacturing flexible rolling of metal strips, in which a metal strip with pre-definable material thickness is guided through a mill stand by at least two operating steps, which includes several rolls, the metallic strip is during the rolling operation set to lead through a roll gap, where a curve bending line is steered to achieve a defined profile.

8 Claims, 1 Drawing Sheet

(51) Int. Cl.

| | |
|---|---|
| ***B21B 38/02*** | (2006.01) |
| ***B21B 37/38*** | (2006.01) |
| ***B21B 37/58*** | (2006.01) |

(58) Field of Classification Search

CPC ..... B21B 38/04; B21B 2261/04; B21B 2261/043; B21B 2261/05

See application file for complete search history.

(56) References Cited

U.S. PATENT DOCUMENTS

| | | | | |
|---|---|---|---|---|
| 6,427,507 | B1 * | 8/2002 | Hong | B21B 38/02 73/862.55 |
| 7,823,428 | B1 | 11/2010 | Malik et al. | |
| 3,050,792 | A1 | 11/2011 | Bergsten | |
| 2005/0164007 | A1 * | 7/2005 | Numrich | B29C 48/9155 428/411.1 |
| 2008/0271508 | A1 * | 11/2008 | Kruger | B21B 37/28 72/12.3 |
| 2010/0050721 | A1 * | 3/2010 | Tezuka | B21B 37/165 72/10.4 |
| 2012/0253502 | A1 * | 10/2012 | Holm | B21B 13/147 700/154 |
| 2016/0059283 | A1 * | 3/2016 | Breuer | B21B 35/06 72/241.4 |
| 2017/0239700 | A1 * | 8/2017 | Mueller | B21B 37/26 |

FOREIGN PATENT DOCUMENTS

| | | | |
|---|---|---|---|
| DE | 19939166 | A1 | 5/2001 |
| EP | 1074317 | A2 | 2/2001 |
| EP | 1080800 | A2 | 3/2001 |
| EP | 1595608 | A1 | 11/2005 |
| JP | S61172603 | A | 8/1986 |

OTHER PUBLICATIONS

International Search Report issued by the European Patent Office acting as the International Searching Authority in relation to International Application No. PCT/EP2017/083296 dated Mar. 2, 2018 (3 pages).

Written Opinion of the International Searching Authority issued by the European Patent Office acting as the International Searching Authority in relation to International Application No. PCT/EP2017/083296 dated Mar. 2, 2018 (7 pages).

Chinese Office Action dated May 21, 2020, issued in corresponding Chinese Appln. No. 201780081632, including English translation, 13 pages.

Chinese Search Report dated May 8, 2020, issued in corresponding Chinese Appln. No. 2017800816327, 2 pages.

European Search Report dated Sep. 8, 2017, issued in corresponding EP Appln. No. 16 20 7599, 6 pages.

Kopp, Translation of EP-1074317-A2 (Year: 2001).

"Revue de Metallurgie (NPL: SI-FLAT contactless flatness measurement for cold rolling mills and processing lines) https://www.researchgate.net/publication/45703735_ SI-FLAT_contactless_flatness_measurement_for_cold_rolling_mills_and_processing_lines (Year: 2005)".

Office Action issued by the USPTO in relation to U.S. Appl. No. 16/474,434 dated Mar. 23, 2021 (11 pages).

Office Action issued by the USPTO in relation to U.S. Appl. No. 16/474,434 dated Jan. 6, 2021 (16 pages).

* cited by examiner

METHOD FOR MANUFACTURING FLEXIBLE ROLLING OF METAL STRIPS

CROSS-REFERENCE TO RELATED APPLICATIONS

This application is a divisional application of U.S. patent application Ser. No. 16/474,434 filed Jun. 27, 2019, which is a national phase entry under 35 U.S.C. 371 of PCT International Application No. PCT/EP2017/083296 filed Dec. 18, 2017, which claims priority to European Patent Application No. 16207599.8, filed Dec. 30, 2016, the disclosure of each of these applications is expressly incorporated herein by reference in their entirety.

The invention pertains to a method for manufacturing metal strips by rolling.

It is generally known to produce different thickness profiles of the strip by using mills. However, in a case of strip width like more than 650 mm it is difficult to manufacture by ordinary mills.

In the description of the process patent EP 1 074 317 B1, a duo- and quarto-mill is mentioned. The patent describes the process of flexible rolling with a quarto or a duo mill. In dependence of the content is focused on the control engineering, measurement systems and the bending of the work roll in dependence to the roll gap setting. The control engineering is divided into the phases of steering and controlling. The steering phase is characterized by the immediate adjustment of the roll gap, so that the transition between two thicknesses (edge) will be achieved. In contrast, during the phase of controlling the flatness and thickness are controlled in minimum one loop (plateau). The flatness is influenced by the bending of the work rolls in a defined relation. The flatness is measured by an optical laser system or a stressometer roll. The patent of EP 1074317 describes the bending of the working rolls. Furthermore it is important to get an utilizable flatness for the following plants after the cold rolling mill.

The patent JP S61-172603 discloses to obtain a different-thickness rolling stock in flatness and yield. That is done by lowering the number of revolutions of rolls and controlling roll crowns in accordance with a load variation at the time of changing a roll gap.

In the patent application JP S61-172603 the operation mode is not able to define the rolling gap with a direct measurement. The method of flexible rolling is based on the working with the position of the hydraulic cylinder, which transmits the force with the ratio of the angular relationship of all axles and rolls. That control process is not connected to the bending during flexible rolling and thus plays significant role during the rolling procedure.

The flatness controlling of the process is mentioned in U.S. Pat. No. 8,050,792 B2 with a known flatness profile, the rolling mill can be provided with a flatness control system that is based on the measured flatness profile and a given target or reference flatness profile computes set points to the available control devices, achieving closed-loop flatness control and connected to the development of their stressometer rolls. It is well known that measurement can be done for example by laser, optical or non-contact techniques.

The invention is based on the flexible rolling of a metallic strip profile, in which the operating concept mode is based on two steps. The first step is called learning phase, which is based on the controlling and storing the parameter values during rolling. The stored parameter values consisting of the thickness and flatness data (positions of the hydraulic adjustment and the flatness actuators) of the strip and those are collected during the learning phase.

The second step to achieve the defined tolerances is called a program-loop, where the values are achieved from the first stage as starting values.

The first step is only for the determination of the parameter set by the learning phase and the second step is the loop for flexible rolling, which is primarily based on the parameters from the first step i.e. by the program-loop to have the start values from the first phase. As a final result the rolling process has the program-loop for collecting, optimizing and using the data through the flexible rolling process. It is possible to use for example a Sendzimir mill for achieving the process steps.

In the second step the special core element is the "learning phase", which allows to react to the strip specific properties and defined profile with different thicknesses over the length of the strip during the manufacturing. Furthermore this process ensures to have a fast control process and it is able to achieve the tolerances by the first profile. The invention is based on the bending of the work rolls, which is depending on the forces like it is mentioned in Patent JP S61-172603 and likewise not on the setting of the rolling gap. The bending stage is divided into two separate sections. The first section is the presetting which is based on already rolled strips which are stored in a database or a manual setting by the operators. After that the controlled part is to get switched on when the flatness measurement is able to deliver data from the rolling process.

In the invention the described bending process is not based on other parameters than the integrated flatness steering process which is influenced by the rolling forces, which is connected to the setting of the rolling. The invention furthermore influences on the bending of the work rolls but slightly in a different way. The reason for that is the Sendzimir mills and the concept of flexible rolling use different stored settings of the actuators for bending at the different thicknesses.

The differences compared to the generally known mills for the flexible rolling of a metallic strip are wider in the invention, which has a greater width, where the area is possible to cover width range of 400 to 1600 mm.

By the method of manufacturing metal strips by flexible rolling of profile the invention is to increase the production depth in automotive, transportation industry where is need for weight reduction. Furthermore structure components, container, tank or exhaust systems are possible to manufacture by this invention. Regarding the implementation of weight reduction, which consists of component integration, thickness reduction in areas with less load and stress oriented component design thickness or strength. These are very important tasks, when needed to reduce emissions.

In individual cases rolling procedure of a metallic strip profile is used by Quarto-Mills and due to that is needed to have a bigger diameter of the working rolls compared to Sendzimir design, where it is possible to use significantly smaller diameters of the working rolls. The benefit of that is to cold roll grades with a higher strength and quality demands like flatness.

A mill structure can consists for example of 20 rolls like in a Sendzimir mill. In that case the eccentric adjustment of four rolls A/B/C/D or only two rolls ND or B/C can be used to influence the flatness of the strip. The eccentric adjustment consists of 5-7 bearings, which could be adjusted individually. The adjustment range of each bearing is about +/−40 mm in the case of ZR22-55. Other mills have a larger adjustment range especially mills up to 1600 mm width. In addition the flatness could be influenced by the first intermediates. They could be shifted transversal to the rolling direction. The displacement path is between 50-300 mm.

The invention reduces, due the width of strip significantly, the amount of scrap and enables better possibilities of nesting which shortens process times in further processing. The Sendzimir-mill requires totally different control engineering in contrast to the construction of a duo or quarto-mill.

Manufacturing metal strips by the flexible rolling profile enables the phase of controlling the thickness and adjusts the work roll bending. Furthermore for a use a part of the edge can be used for the evaluation of the plateau based on the area integral.

The bending of the working rolls depends on the needed working force to roll a specific grade. The steering is based on the reference variables of the flatness measurement system which is allocated to different conditions (thickness/force).

The objective of the invention is also to attain with a device for manufacturing metal strips features by a rolling stand which contains several rolls, wherein at least one upper and at least one lower roll adjoin the upper and the lower surface of the metal strip under the influence of pressure, and wherein the wider width is more than 650 mm to be produced on the metal strip. During the manufacturing process a strip profile with different thicknesses over the length of the strip is achieved. The defined profile can consist of two, three or more different thicknesses over the length of the strip. Essential features of the inventive device are disclosed in the attached claims.

On the contrary to the prior art, the bending process of the invention is connected to the forces of the rolling process and steered in dependence of the transition time and not based on other parameters, in particular. Stainless steel and other metals therefore can be processed by means of rolling, particularly cold-rolling, in a continuous operation, wherein width range of 400 and 1600 mm can be realized.

This is achieved with a different cold rolling mill type, where the differences are the number of rolls and actuators (hydraulic adjustment, crowns, first intermediates) to influence the thickness and flatness.

The existing standard process is focused on a consistent thickness above the strip length in close tolerance limits. In contrast to that, the flexible rolling is characterized by different thicknesses in short distances but none the less in close tolerance limits. One profile which is normally between 500 and 2000 mm long repeats continuously above the length of the strip. This process requires continuous highly dynamic changes of the cold rolling mill. Hereinafter the key issues to implement the process are mentioned. In addition the control engineering takes the characteristic of the mill type into account and permits faster regulation of the process. Furthermore the specific properties of every strip profile are considered because the bending of the work roll is not depending on the rolling gap.

As in the prior art, it is also possible to utilize multi-roll rolling stands such as, for example, Sendzimir rolling stands in order to technically realize the corresponding metal strips.

The following principle applies in this respect: the softer the metallic material of the metal strip, the smaller the number of rolls used may be chosen. The typical metallic materials are consisting for example of copper, aluminum, stainless steel or steel.

The object of the invention makes it possible to form metal strips consisting, in particular, of stainless steel and other metals with the aid of a continuous rolling process, particularly a single-pass or multi-pass cold-rolling process, preferably in a multi-roll stand, so that is possible to roll a profile in rolling direction.

There are also possibilities to manufacture a metal strip by rolling to the industry areas like for automotive or transportation industry, and further in building industry.

An exemplary embodiment of the object of the invention is illustrated in the drawings and described in greater detail below. In these drawings.

Figure 1:
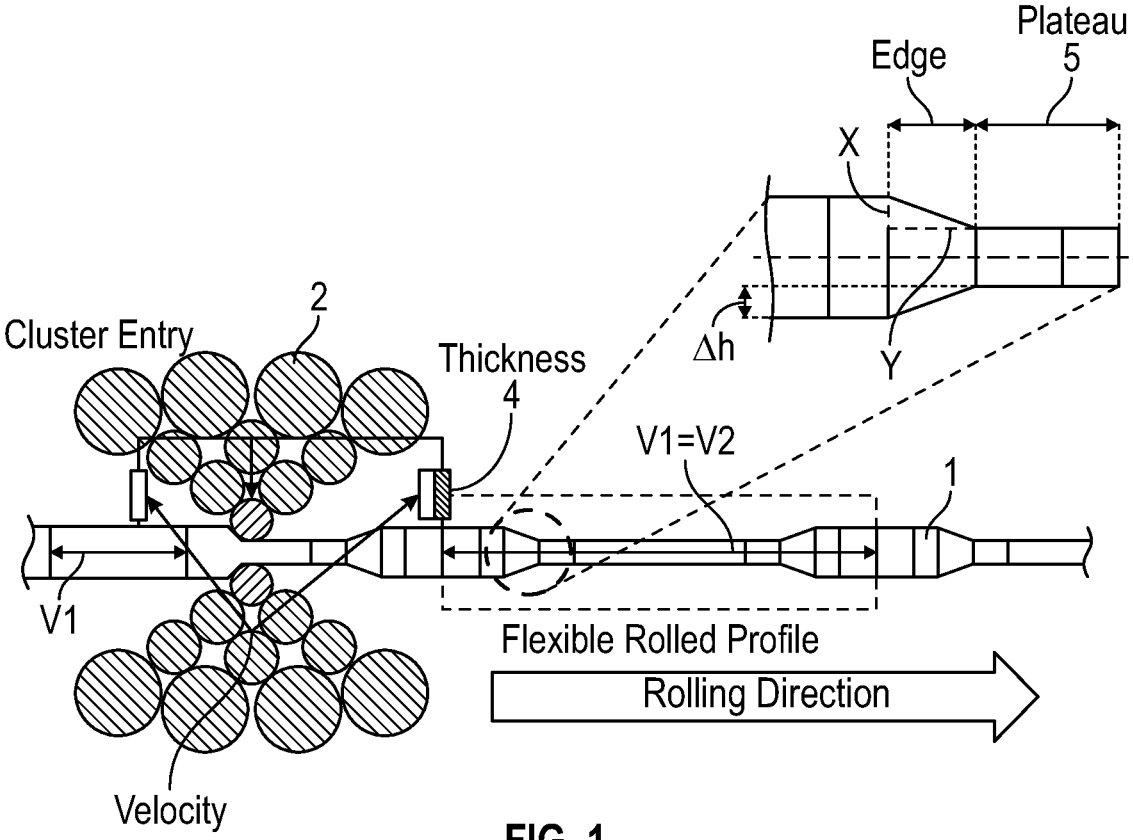
FIG. 1 shows a schematic diagram of rolling stands for profiling a metal strip and the geometry definition of the flexible rolled strip.

FIG. 1 shows a schematic diagram of the rolling stands. A metal strip is produced by a Sendzimir mill in a width range of 400 and 1600 mm which is recurring above the length of the strip. The concept of the invention is especially focused on flexible rolling. The existing standard process is focused on a consistent thickness above the strip length in close tolerance limits. In contrast to that, the flexible rolling is characterized by different thicknesses in short distances but none the less in close tolerance limits. One profile, which is normally between 500 and 2000 mm long repeats continuously above the length of the strip. This process requires continuously highly dynamic changes of the cold rolling mill. The V adjustment increases for example by factor 3.5 because of the spring rate of the mill and this is multiplied by 14-30, preferable 18-26 is the velocity of the hydraulic cylinder. Typical numbers for velocity of the hydraulic cylinder are a range between 0.17 mm/s and 5.83 mm/s, where 0.17 mm/s (rolling gap) 13.09 mm/s (hydraulic cylinder) and 5.83 mm/s (rolling gap) 448.91 mm/s (hydraulic cylinder). In a FIG. 1 is a sketch of a geometry definition after rolling a metallic strip. The steering phase is characterized by the immediate adjustment of the roll gap (edge), so that the transition between two thicknesses will be achieved. In FIG. 1 during the phase of controlling the thickness is controlled in minimum one loop (plateau). During the controlled phase it is possible to influence the flatness actuators manually. The flatness gets influenced by the bending of the work rolls in a defined relation. The flatness can be measured for example by an optical laser system, a stressometer roll or a SI-Flat System. The process of the roll gap adjustment is steered by switching to a controlled phase during the rolling of the plateau. The use of a following plateau which is already rolled to control the plateau between the working rolls. Furthermore two existing systems are to measure the flatness of the strip. A contactless SI-Flat System can be used, which is based on the evaluation of the local amplitude of oscillation.

Figure 2:
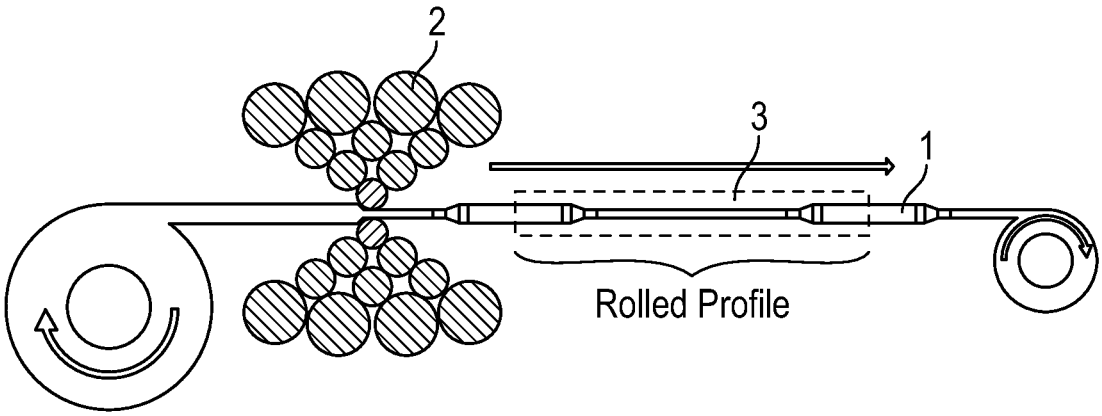
FIG. 2 shows a schematic diagram of a metal strip that is wound up on a coil with subsequent cold deformation and another coiling operation and measuring of the plateau to control the process.

FIG. 2 shows the number of rolls and the actuators (hydraulic adjustment, crowns, first intermediates) to influence the thickness and flatness. In addition the control engineering takes the characteristic of the mill type into account and permits faster regulation of the process. Furthermore the specific properties of every metal strip are considered because the bending of the work roll is not depending on the rolling gap. Furthermore the figure shows a defined profile with different thicknesses over the length of the strip. The bending is necessary for the process. By using a 20 roller instead of duo- and quarto-mill the final result will be a flat and higher strength strip. The bending of the working rolls depends on the needed working force to roll a specific grade. The steering of the work roll bending is based on the reference variables of the flatness measurement system, which are determined during the "learning phase".

The invention claimed is:

1. A manufacturing method for flexible rolling of metal strips, comprising:

guiding a metal strip with a pre-definable material thickness through a mill stand containing several rolls, wherein the metal strip is set to lead through a roll gap during the rolling operation, where bending of the work rolls is steered to achieve a defined profile with different thicknesses over a length of the metal strip, based on two operating steps of a rolling operation;

a first step of the two operating steps is a learning phase based on manually controlling and storing parameter values of hydraulic adjustment and flatness actuators during rolling of the defined profile, during which thickness and flatness data of the strip are collected;

wherein the flatness actuator parameters are controlled to steer bending of the work rolls to achieve the defined profile; and a second step of the two operating steps is repeating a program loop for flexible rolling having starting values from the first step for providing a strip having the defined profile repeatedly formed over the length of the strip;

wherein the starting values from the first step include the thickness and flatness data collected during the first step and the parameter values of the hydraulic adjustment and flatness actuators stored during the first step.

2. The method according to claim 1, wherein the defined profile comprises different thicknesses over a length of the metal strip.

3. The method according to claim 1, wherein the defined profile comprises at least two thicknesses over a length of the metal strip.

4. The method according to claim 1, wherein the metal strip comprises a width range of 400 to 1600 mm.

5. The method according to claim 1, further comprising work roll bending in dependence on the rolling force to influence flatness of the metal strips.

6. The method according to claim 1, further comprising setting three existing systems to measure flatness of the metal strip.

7. The method according to claim 1 wherein the flatness data is collected by a contactless flatness measuring system.

8. The method according to claim 1, wherein a width range of the metal strip is 400 to 1600 mm.

* * * * *